United States Patent [19]

Hagstrom et al.

[11] Patent Number: 4,595,197

[45] Date of Patent: Jun. 17, 1986

[54] WHEELED EXERCISE DEVICE

[76] Inventors: David R. Hagstrom, 802 S. 31st St.; Gregory J. Gaudreau, 2114 Burnstead Dr., both of Billings, Mont. 59101

[21] Appl. No.: 559,684

[22] Filed: Dec. 9, 1983

[51] Int. Cl.[4] ..... A63B 21/00

[52] U.S. Cl. ..... 272/127

[58] Field of Search ..... 272/127, 93, 96; 280/200, 242 R, 32.5, 47.13 R, 11.19, 11.25, 87.02 W; 128/87 C

[56] References Cited

U.S. PATENT DOCUMENTS

| | | | |
|---|---|---|---|
| 1,997,139 | 4/1935 | Gardener et al. | 272/96 |
| 3,044,797 | 7/1962 | Borland | 280/87.02 W |
| 3,532,356 | 10/1970 | Lillibridge | 272/127 X |
| 3,767,191 | 10/1973 | Riley | 272/127 X |
| 3,784,192 | 1/1974 | Nutter | 272/127 |

FOREIGN PATENT DOCUMENTS

| | | | |
|---|---|---|---|
| 663233 | 8/1938 | Fed. Rep. of Germany | 272/127 |

*Primary Examiner*—Richard J. Apley
*Assistant Examiner*—William R. Browne
*Attorney, Agent, or Firm*—Harvey B. Jacobson

[57] ABSTRACT

An exercise device comprises a pair of wheels on opposite ends of an axle, and a pair of foot-receiving stirrups on the axle between the wheels. A user positions his or her feet in the stirrups, assumes a basic push-up position on a support surface and exercises either by walking along the surface on the hands, rolling the feet behind, or by maintaining the hands in stationary position and using the body to roll the wheels toward and away from the hands.

6 Claims, 5 Drawing Figures

WHEELED EXERCISE DEVICE

BACKGROUND OF THE INVENTION

This invention relates to an exercise device and novel methods of exercising. The invention provides an exercise device which can be economically manufactured, which is of convenient size and weight for shipment and transportation, and which can be used in any convenient location to provide exercise for a substantial number of body muscle groups. The invention also provides novel forms of exercise using the device.

DESCRIPTION OF THE PRIOR ART

Acknowledgment is made of the following U.S. patents pertaining to exercise devices in general, none of which is believed to disclose the features of the present invention:

U.S. Pat. No. 623,717, Apr. 25, 1899
U.S. Pat. No. 1,023,883, Apr. 23, 1912
U.S. Pat. No. 1,697,994, Jan. 8, 1929
U.S. Pat. No. 2,400,535, May 21, 1946
U.S. Pat. No. 3,403,906, Oct. 1, 1968
U.S. Pat. No. 3,672,670, June 27, 1972
U.S. Pat. No. 3,680,889, Aug. 1, 1972
U.S. Pat. No. 3,833,215, Sept. 3, 1974
U.S. Pat. No. 4,073,504, Feb. 14, 1978

SUMMARY OF THE INVENTION

An exercising device in accordance with the invention comprises an axle member, stirrup means or the like associated with the axle member for releasably supporting both of a user's feet on the axle member, and wheel means associated with the axle member for providing rolling support for the axle member and stirrup means on a support surface with ground clearance for the user's feet.

A method of exercising in accordance with the invention comprises assuming a basic push-up position on a support surface, with the feet supported on wheel means above the surface, then performing at least one of the actions comprising (a) walking along the surface on the hands with the wheel means rolling along the surface and (b) maintaining the hands in substantially stationary position on the surface and using the body to roll the wheel means along the surface toward and away from the hands.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 2:
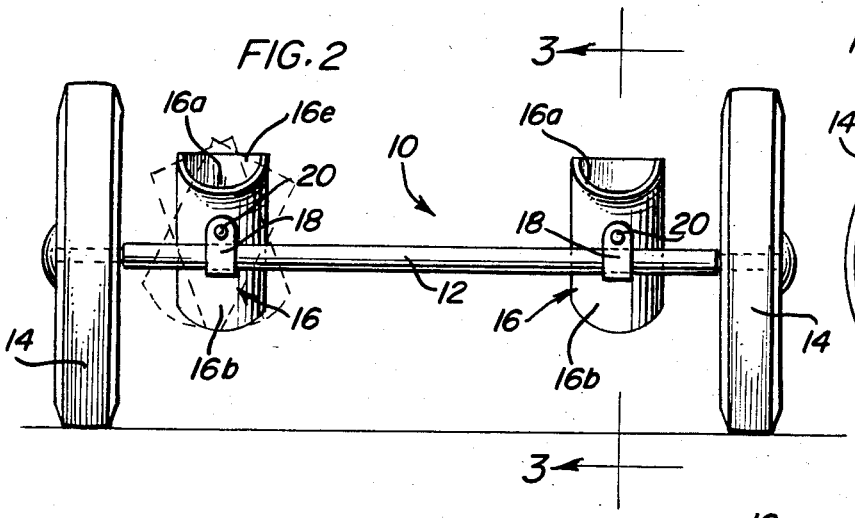
FIG. 2 is an elevational view of the exercise device.
Figure 3:
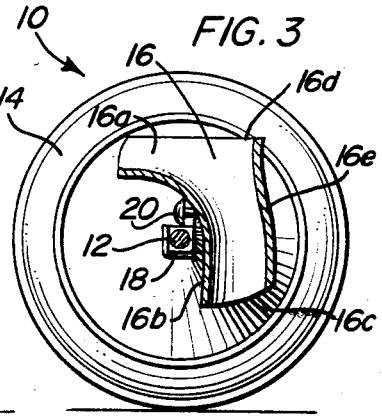
FIG. 3 is a sectional view on line 3—3 of FIG. 2.
Figure 4:
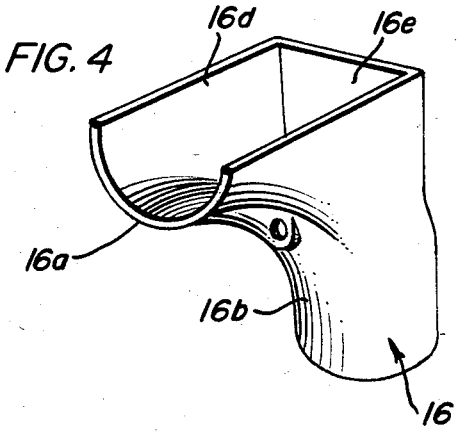
FIG. 4 is a perspective view of a foot stirrup.

As shown more particularly in FIGS. 2 and 3, an exercising device 10 in accordance with a first embodiment of the invention comprises a rigid axle 12 with a pair of wheels 14 rotatably secured at its opposite ends for rotation about an axis defined by the axle, and a pair of hollow boot-shaped stirrups 16 adjustably mounted on the axle between the wheels. The stirrups may, for example, be molded in plastic or other suitable material, and are each generally L-shaped (as shown in FIG. 4) so each stirrup includes a shin support portion **16*a* and a foot receiving portion 16*b* with an open toe 16*c*. As shown, the stirrup shin support portion 16*a* has an open top at 16*d* and the foot receiving portion 16*d* has a rear wall 16*e* which engages the sole of a shoe 17 worn by a person 19 using the device with the breast of the heel 17*a* engaging the upper edge of the rear wall 16*e* to limit insertion of the shoe 17 into the stirrup 16**. The interior surface of the stirrup may be padded for secure engagement with the feet or shoes of the user.

The stirrups 16 are mounted on axle 12 by collars 18 connected to the respective stirrups by pivotal connectors 20 allowing a user to swivel his or her feet when mounted in the stirrups. Also, suitable adjustment means (not shown) such as set screws may be provided for altering the position of the stirrups along axle 12 to suit a particular user. The diameter of wheels 14 are such as to provide ground clearance for a user's feet when slid into the stirrups. The wheels may, for example, be about 12 inches in diameter, axle 12 may be 26 inches long, and the stirrups may be about 20 inches apart.

Figure 1:
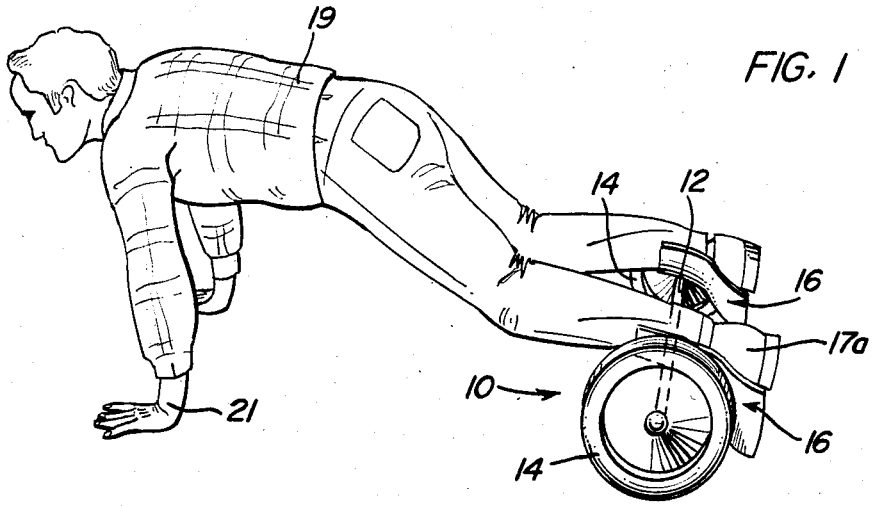
FIG. 1 is a perspective view of a person performing an exercise and using an exercise device in accordance with the invention.

To perform exercises in accordance with the invention, a user positions his or her feet in the stirrups, and assumes a basic push-up position on any suitable support surface, as shown in FIG. 1. From this position, the user 19 may, for example, perform an exercise comprising walking along the surface on the hands 21, with the feet being rollingly supported by the exercise device. Another exercise comprises maintaining the hands 21 in stationary position, the user would draw their feet uo toward the hands while raising the rump as the feet were drawn under the body until a "front-line" football stance position is achieved and then extending the legs into the starting push-up position thus completing one exercise. Other exercises such as conventional push-ups may be practiced with the arms being in different angular relations to the user's body.

Figure 5:
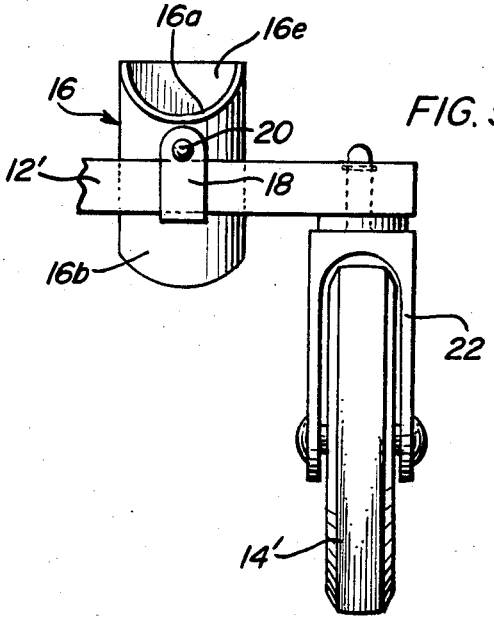
FIG. 5 is an elevational view of a part of a modified form of exercise device in accordance with the invention.

In the modified form of the invention shown in FIG. 5, wheels 14' are journaled in caster yokes 22 which have a vertical pin 24 extending through axle 12'. This arrangement allows the wheels to swivel about a vertical axis and provides the device with a further degree of flexibility. It may also be possible for the device to have only a single wheel between the stirrups instead of wheels at the ends of the axle and only one stirrup may be provided or used to even further strengthen certain muscles. The castering support wheels 14' and the swiveling stirrups 16 enables the exercise device and thus the legs to be moved laterally to increase the types of exercises which can be practiced by using the exercise device.

It will be appreciated that the invention provides a compact and lightweight exercising device which can be used in any convenient location, including confined areas, to provide extremely effective exercise to many parts of the body including the stomach, chest, shoulders, arms and back.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. An exercise device comprising only one axle member, means for supporting a user's feet on the axle member, and wheel means associated with the axle member for providing rolling support for the axle member on a support surface and clearance for the user's feet from said surface with the user's feet engaging the supporting means, wherein the feet supporting means comprises a pair of stirrups on the axle member shaped for receiving the user's feet therein and for engaging and supporting the user's shins, the device including connector means for connecting the respective stirrups to the axle member in front of the user's respective ankles.

2. The invention of claim 1 wherein the stirrups are each of hollow molded configuration open at the back.

3. The invention of claim 1 wherein the stirrups are pivotally mounted on the axle member for pivotal movement about an axis generally perpendicular to the axle member.

4. The invwntion of claim 1 wherein the stirrups are mounted for lengthwise adjustment on the axle member.

5. The invention of claim 1 wherein the wheel means comprises a pair of wheels at opposite ends of the axle member.

6. The invention of claim 5 wherein the wheels are castering wheels secured to the axle member for swiveling movement about an axis perpendicular to the axle member.

* * * * *